US005762193A

United States Patent [19]

Marco

[11] Patent Number: 5,762,193

[45] Date of Patent: Jun. 9, 1998

[54] CLIP-ON SHEET FOR CONTAINER CARRIER

[75] Inventor: Leslie S. Marco, Bloomingdale, Ill.

[73] Assignee: Illinois Tool Works Inc., Glenview, Ill.

[21] Appl. No.: 735,515

[22] Filed: Oct. 23, 1996

[51] Int. Cl.[6] ..... B65D 71/12

[52] U.S. Cl. ..... 206/427; 206/153

[58] Field of Search ..... 206/145, 147, 206/152, 153, 155, 158, 199, 427

[56] References Cited

U.S. PATENT DOCUMENTS

| | | | |
|---|---|---|---|
| 3,118,537 | 1/1964 | Copping . | |
| 3,245,711 | 4/1966 | Dantoin . | |
| 3,302,784 | 2/1967 | Copping | 206/153 |
| 4,844,328 | 7/1989 | Cooper | 206/427 |
| 4,974,726 | 12/1990 | Klygis et al. . | |
| 5,230,425 | 7/1993 | Edqvist et al. . | |
| 5,323,585 | 6/1994 | Kazlauskas . | |
| 5,425,446 | 6/1995 | Weaver et al. . | |
| 5,538,133 | 7/1996 | Campbell et al. | 206/153 |

FOREIGN PATENT DOCUMENTS

| | | | |
|---|---|---|---|
| 1445712 | 8/1976 | Canada | 206/153 |

*Primary Examiner*—David T. Fidei

*Attorney, Agent, or Firm*—Speckman Pauley Petersen & Fejer

[57] ABSTRACT

A sheet that cooperates with a traditional ring carrier to create a package that covers openable ends of unitized substantially similar cans. The ring carrier unitizes an array of cans into longitudinal ranks and transverse rows. The sheet contains an array of longitudinal, substantially parallel pairs of slits corresponding with the arrayed cans. The corner slits are substantially curved and promote a positive corner wrap at the corner end of the slit. A slit transversely adjacent the corner slit is curved and a slit longitudinally adjacent to the corner slit is straight for most of its length. Two integral flaps extend transversely with respect to the sheet and are folded with respect to the remaining portion of the sheet through an angle greater than 90°. Clipping the sheet onto the array of cans unitized by the ring carrier creates an assembled package. Portions of the sheet adjacent each pair of slits engage a portion of the chime of each corresponding can. Because of the slit and pre-folded integral flap configurations according to this invention, the integral flaps remain in a substantially flat position with respect to the sidewalls of the outside rows of cans.

9 Claims, 3 Drawing Sheets

CLIP-ON SHEET FOR CONTAINER CARRIER

BACKGROUND OF THE INVENTION

1. Field of the Invention

This invention relates to a sheet for stabilizing and covering an array of substantially identical unitized containers.

2. Description of Prior Art

Conventional container carriers are often used to unitize a plurality of similarly sized containers, such as cans, bottles, jars and boxes, although other packages or containers may be unitized. Traditionally, can carriers are either thermoplastic ring carriers or single-piece paperboard box carriers. Each of these carriers has advantages and disadvantages.

The ring carrier produces a unitized package for cans using little material. However, when used alone the carrier exposes the openable ends of the cans and has little or no advertising or promotional printing space. Conversely, the box carrier generally covers the openable ends of the cans and has a relatively large amount of area for promotional graphics. Disadvantageously, the box carrier requires a relatively large amount of material, has an awkward cut-out handle susceptible to tearing, and usually does not reveal the actual containers.

Therefore, there is a need for a package that incorporates the stability and economy of a ring carrier and the can coverage and promotional area of a box carrier. As a result, hybrid packages having a combination of a ring carrier and a paperboard component are desirable.

Klygis et al., U.S. Pat. No. 4,974,726, discloses a generally planar sheet of paperboard or polymeric material for stabilizing a rectangular array of cans of a type having an end with a chime and for covering substantial portions of the chime ends of the arrayed cans, the disclosure of which is incorporated into this specification by reference.

The Klygis et al. patent teaches a combination of the planar sheet and a traditional ring carrier. As disclosed in the Klygis et al. patent, the sheet has multiple pairs of substantially parallel slits that engage the chimes of all of the arrayed cans. The pairs of slits are arranged in longitudinal rows and transverse ranks. The Klygis et al. patent teaches pairs of slits that are identically configured across all rows and ranks. The slits taught by the Klygis et al. patent are substantially straight except the slits' opposite ends, which are slightly curved.

Weaver et al., U.S. Pat. No. 5,425,446, teaches another sheet for engaging and substantially covering the chime ends of an array of cans. The cans are arrayed with a polymeric ring carrier. The Weaver et al. patent teaches a sheet having curved slits along only an outer margin of the sheet. The sheet taught by the Weaver et al. patent has a large side flap that is attached to the ring carrier.

Sheets such as those described in this specification may be applied with the use of an applicating machine like that taught in Kazlauskas, U.S. Pat. No. 5,323,585. The Kazlauskas patent teaches a method for clipping sheets having an array of can-receiving slits onto a corresponding array of unitized containers using a succession of spaced wheels.

SUMMARY OF THE INVENTION

It is one object of this invention to provide a sheet that stabilizes a unitized package of cans into a sturdy package.

It is another object of this invention to provide a sheet that covers a substantial portion of each of the chime ends of an array of cans.

It is another object of this invention to provide a sheet having generally flat surfaces that can display advertising and promotional graphics.

It is still another object of this invention to provide a sheet that does not require direct attachment to a can-receiving ring carrier.

The sheet of this invention cooperates with a traditional ring carrier to create a package containing substantially similar cans. The ring carrier is used to unitize an array of cans into longitudinal ranks and transverse rows. The cans generally comprise a cylindrical sidewall and an openable end having a chime.

The sheet of this invention is preferably constructed of scored paperboard. The sheet contains an array of longitudinal, substantially parallel pairs of slits corresponding with the cans within the array in the ring carrier. In a preferred embodiment of this invention, the corner slits are substantially curved and promote a positive corner wrap at the corner end portion of the slit. Preferably, a slit transversely adjacent to the corner slit is curved. Additionally, a slit longitudinally adjacent to the corner slit is straight for most of its length.

Preferably, two integral flaps extend transversely with respect to the sheet. According to one preferred embodiment of this invention, the length of each flap is less than the overall length of the sheet.

The array of cans within the ring carrier and the sheet placed on top of the cans result in an assembled package. According to one preferred method of application of the sheet to the cans, prior to application the integral flaps are folded downwardly with respect to the rest of the sheet through an angle greater than 90°.

Preferably, portions of the sheet adjacent each pair of slits engage a portion of the chime of each corresponding can. The sheet substantially covers the openable ends of the cans and the positive corner wrap preferably contained in the corner slits helps position and secure the sheet with respect to the cans. Preferably, because of the slit and pre-folded flap configuration according to this invention, the integral flaps remain in a substantially flat position with respect to the sidewalls of corresponding outside rows of cans.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
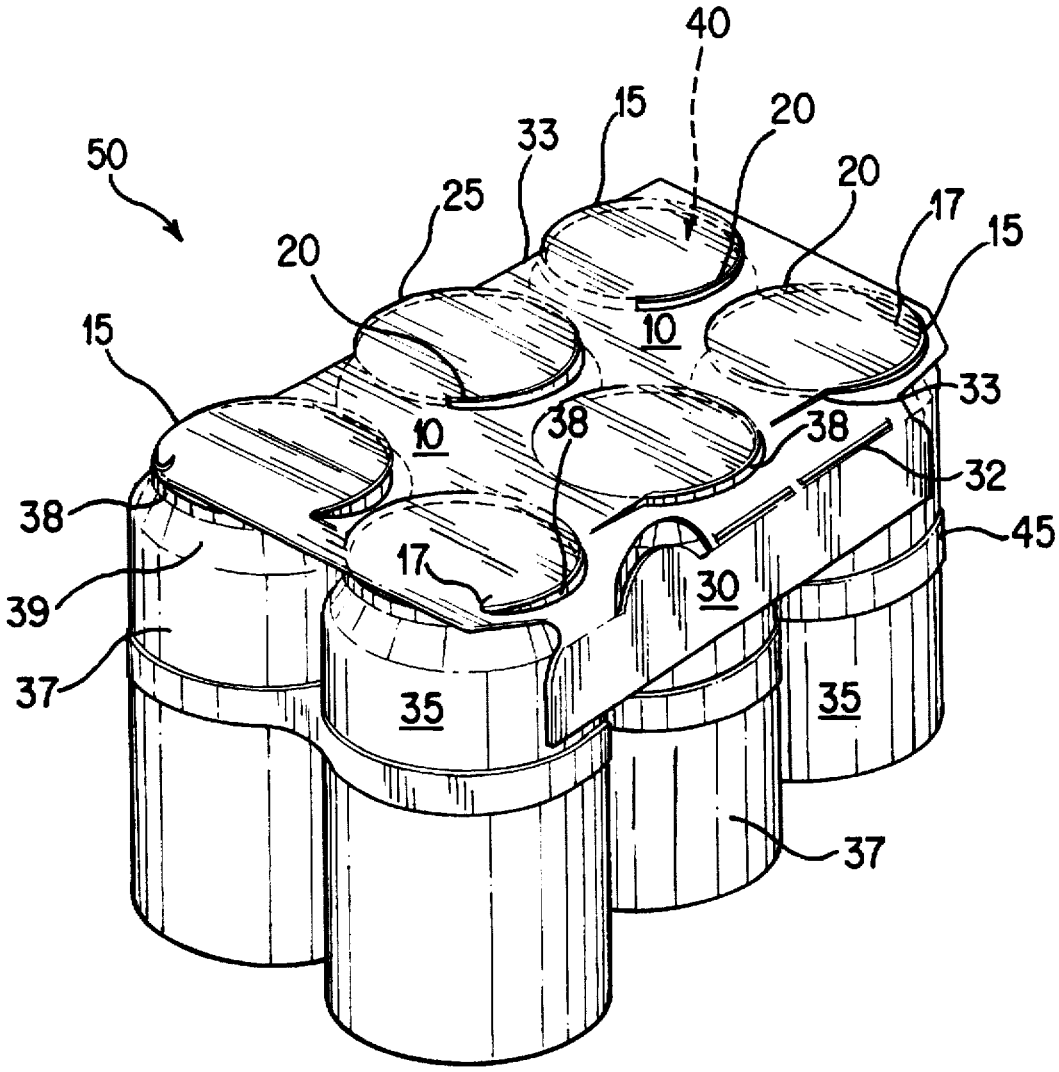
FIG. 1 is a perspective view of a package, assembled with respect to substantially identical unitized cans, according to one preferred embodiment of this invention.
Figure 3:
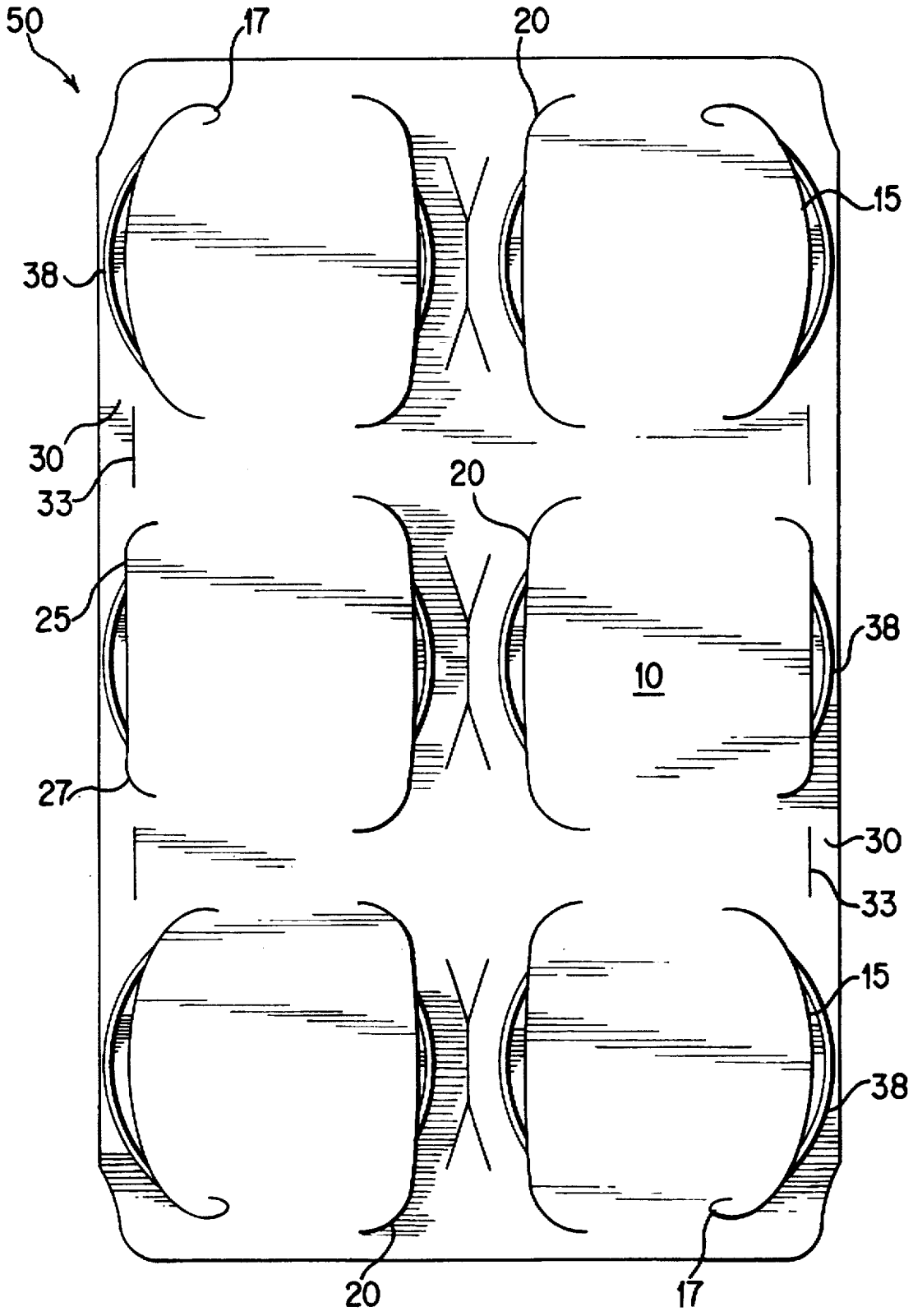
FIG. 3 is a top view of the package shown in FIG. 1, according to one preferred embodiment of this invention.

An assembled package 50, shown in FIGS. 1 and 3, comprises sheet 10 according to this invention, together with a plurality of cans 35 and ring carrier 45.

According to one preferred embodiment of this invention, as shown in FIG. 1, ring carrier 45 unitizes six cans 35, each having cylindrical sidewall 37, openable end 40, chime 38 and tapered region 39 between cylindrical sidewall 37 and chime 38. Chime 38 comprises a relatively small protruding seam around a perimeter of openable end 40. Preferably, frictional forces between ring carrier 45 and an approximate central portion of sidewall 37 retains each can 35, although cans 35 may alternatively be retained by ring carrier 45 mounted around chime 38. Ring carrier 45 retains cans 35 in an array of longitudinal rows and transverse ranks, preferably with all openable ends 40 facing in a common direction.

Ring carrier 45 may unitize cans 35 in arrays of six, eight, twelve, twenty-four or any other suitably sized array known to those skilled in the art. Preferably, cans 35 are of an even number such that equal numbers of cans 35 are found in each rank and equal numbers of cans 35 are found in each row. Ring carrier 45 may also include an integral handle section, not shown in the drawings, to facilitate handling package 50.

Sheet 10 is applied to openable ends 40 of arrayed cans 35 to form package 50. According to preferred embodiments of this invention, sheet 10 material comprises paperboard, pointboard, or any other suitable substantially self-supporting sheet material. Ordinarily, sheet 10 contains, on one or both sides, UPC and proof of purchase labels, graphics, and promotional and/or other information related to the package contents. Sheet 10 is preferably die-cut to create a generally rectangular overall shape and has a series of slits and cutouts described below.

Sheet 10 contains a plurality of pairs of slits generally arranged in slit pairs which correspond to the array of cans 35 contained in ring carrier 45. Therefore, ring carrier 45 holding six cans 35 preferably requires twelve slits within sheet 10. However, the number of cans 35 may outnumber slit pairs, especially in larger arrays of cans. In one preferred embodiment of this invention, an overall length of the slits extends in a longitudinal direction of sheet 10. Several of the slits have different features as described below.

Corner slits 15 are preferably each positioned in a corner of sheet 10, at an intersection between an outermost row of the longitudinal rows and an outermost rank of the transverse ranks. Corner slits 15 are generally curved slits having opposite end portions directed toward a center region of sheet 10. In one preferred embodiment of this invention, corner slits 15 have a concave portion that faces the center region of sheet 10. Preferably, the overall longitudinal distance 55 between end portions of corner slit 15 is less than a diameter of can 35 at chime 38.

Preferably, one end portion 17 of corner slit 15 contains a positive wrap which in a direction from the generally straight portion begins to extend toward the center region of sheet 10 and then sharply curls around toward the inside of corner slit 15. This hook shaped, positive wrap end portion 17 is preferably positioned at a corner area of sheet 10, as shown in FIG. 1.

Straight slits 25 are located along the outermost rows of the longitudinal rows in the inner ranks of sheet 10. In one preferred embodiment of this invention, straight slit 25 further comprises curved end portion 27 extending from one or both ends of the generally straight portion of straight slit 25. Curved end portions 27 have a concave shape which in a direction from the generally straight portion of straight slit 25 faces the center region of sheet 10. Preferably, the overall longitudinal distance 51 between end portions of straight slit 25 is less than the diameter of can 35 at chime 38.

Figure 2:
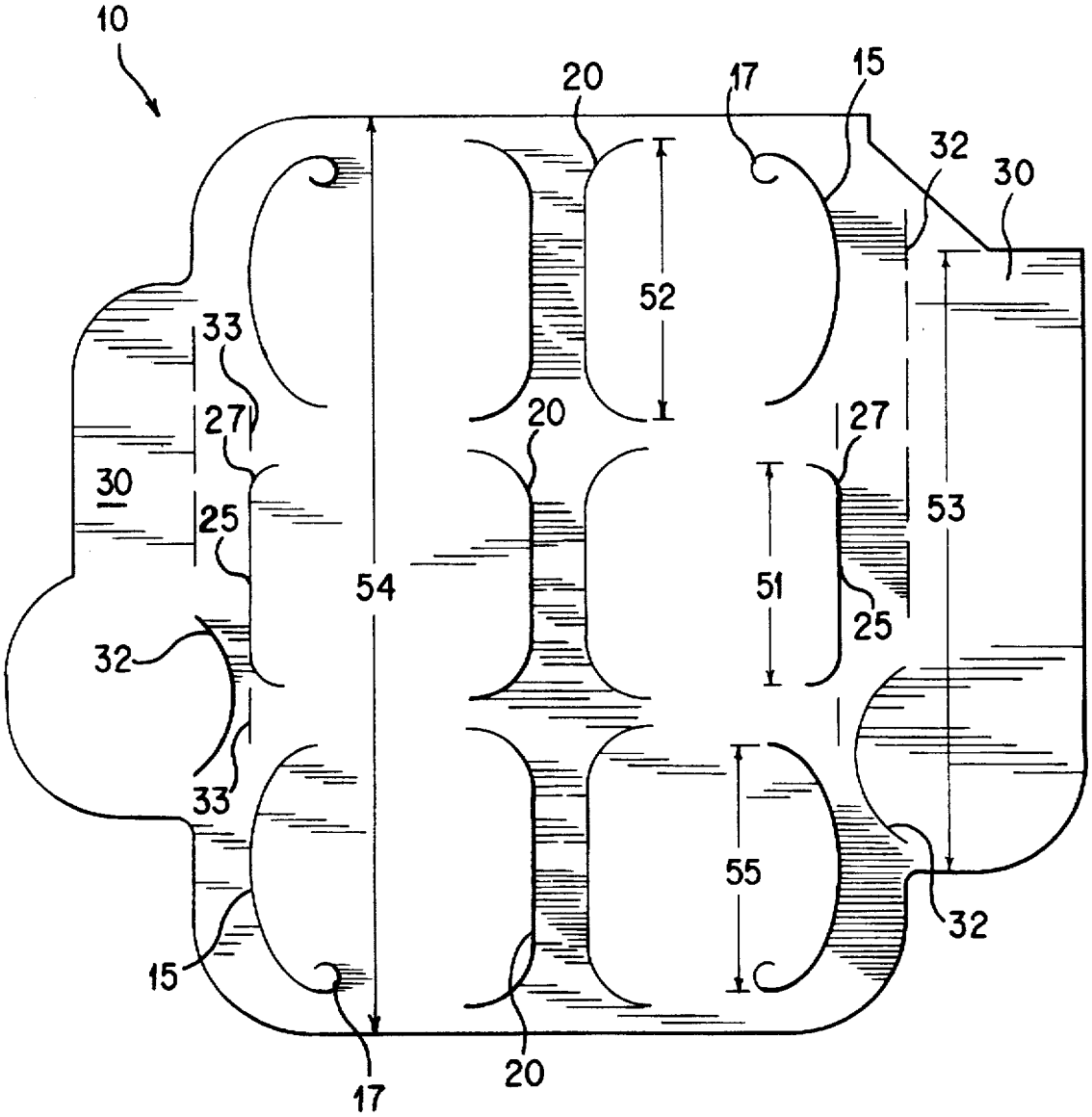
FIG. 2 is a top view of a sheet prior to clipping onto the cans to assemble the package shown in FIG. 1, according to one preferred embodiment of this invention.

Inner slits 20 are positioned in the inner rows of slits in sheet 10. In one preferred embodiment, each pair of slits includes an inner slit 20. Preferably, the overall longitudinal distance 52 between end portions of inner slit 20 is approximately the same as the diameter of can 35 at chime 38. Inner slit 20 is preferably curved, having opposite end portions that extend toward an outside region of sheet 10, as shown in FIGS. 1–3. Therefore, a concave portion of inner slit 20 preferably faces a concave portion of curved end portion 27 of straight slits 25 in the inner ranks of sheet 10. In the outer ranks of sheet 10, the concave portion of inner slit 20 preferably faces the concave portion of corner slits 15.

In one preferred embodiment of this invention, shown in FIGS. 1–3, sheet 10 comprises folding slits 33 longitudinally aligned approximately with corner slit 15 and straight slit 25 along the outermost row of the longitudinal rows. Preferably, at least one folding slit 33 is located between each corner slit 15 and straight slit 25. Folding sheet 10 along a line defined by folding slits 33 helps sheet 10 retain cans 35 and reduces warping of sheet 10.

Sheet 10 also includes at least one integral flap 30 that preferably extends transversely with respect to sheet 10. Integral flap, 30 preferably has an overall longitudinal flap length 53 less than an overall longitudinal sheet length 54, as shown in FIG. 2. In one preferred embodiment of this invention, shown in FIG. 2, two integral flaps 30 extend from each transverse edge of sheet 10, directly adjacent the outermost longitudinal rows of slits.

As shown in FIG. 2, sheet 10 is preferably scored during the die-cut process between integral flap 30 and the outermost longitudinal row of slits to create folding line 32. Folding line 32 may comprise one or more straight cuts or, in other preferred embodiments, an arcuate cut as shown in FIGS. 1 and 2. Folding line 32 between integral flap 30 and the outermost longitudinal row of slits permits integral flap 30 to fold down into a perpendicular position with respect to sheet 10.

In one preferred method of this invention, prior to application of sheet 10 to cans 35, each integral flap 30 is folded downwardly with respect to the rest of sheet 10 along folding line 32, such that integral flap 30 is folded through an angle greater than 90°. Upon application of sheet 10 to cans 35 unitized by ring carrier 45, sheet 10 creates package 50 as described below.

Each slit pair preferably corresponds with a respective can 35 in the array of cans contained by ring carrier 45. Each slit preferably engages with chime 38 of can 35. When sheet 10 is applied, a portion of chime 38 projects through the corresponding slit such that a portion of sheet 10 adjacent the slit contacts an underside surface of chime 38.

As shown in FIG. 1, portions of sheet 10 directly adjacent corner slits 15, inner slits 20, and straight slits 25, abut cans 35 directly beneath chimes 38 of corresponding cans 35. Because ring carrier 45 is resilient and pulls cans 35 together, sheet 10 that spaces cans 35 tends to stress package 50 from inside package 50. Also, sheet 10 resists lateral movement of openable ends 40 of cans 35 with respect to one another. The combination of sheet 10 stressing package 50 and resisting lateral movement of openable ends 40 of cans 35 creates a stable package 50.

Portions of sheet 10 adjacent corner slits 15 and inner slits 20 engage a large portion of chime 38 as a result of the curved shape of the slit, shown in FIG. 2, following the contour of chime 38 surface. Therefore, the slit pairs in corner and outer central positions within the array of assembled package 50 engage cans 35 around a relatively large percentage of a perimeter of chime 38.

Positive wrap end portion 17 of corner slit 15 encourages further mating contact between chime 38 and sheet 10 directly adjacent corner slit 15.

Portions of sheet 10 adjacent straight slits 25 engage very little chime 38 surface as a result of the contrast between straight surface of sheet 10 portion and curved surface of chime 38. The resulting contrast between the sheet surface adjacent straight slit 25 and chime 38 urges integral flap 30 into a perpendicular position with respect to the remainder of sheet 10. Additionally, folding slits 33 along the outermost row of longitudinal rows of slits urge integral flap 30 into a perpendicular position with respect to the remainder of sheet 10. Finally, the pre-folded integral flaps 30 result in integral flap 30 realizing a perpendicular position with respect to the remainder of sheet 10 upon application. The resulting position of integral flap 30 helps display information printed on sheet 10 and creates the appearance of package 50 as a coherent unit. Additionally, as a result of straight slit 25 and folding slit 33 configurations, integral flap 30 does not require attachment to ring carrier 45 to achieve the desired downwardly folded position.

While in the foregoing specification this invention has been described in relation to certain preferred embodiments thereof, and many details have been set forth for purpose of illustration, it will be apparent to those skilled in the art that sheet 10 and the assembly of package 50 are susceptible to additional embodiments and that certain of the details described herein can be varied considerably without departing from the basic principles of the invention.

We claim:

1. In a sheet for stabilizing and covering a plurality of openable ends of similar cans bound in a rectangular array by a can-receiving ring carrier, the sheet having a plurality of pairs of substantially parallel slits configured for clipping the sheet over and covering portions of the openable ends, a portion of a chime of at least one of the openable ends extending through a corresponding slit, the slits arrayed in longitudinal rows and transverse ranks, the improvement comprising:

a curved corner slit located at an intersection between an outermost row of the longitudinal rows and an outermost rank of the transverse ranks, the curved corner slit forming a positive wrap end portion;

a curved inner slit located in an inner row of the longitudinal rows, the curved inner slit transversely adjacent the curved corner slit;

a straight slit located in an inner rank of the transverse ranks, the straight slit longitudinally adjacent the curved corner slit; and the sheet having at least one integral flap extending transversely with respect to the sheet, the integral flap having an overall longitudinal flap length less than an overall longitudinal sheet length.

2. The sheet of claim 1 wherein an overall length of each of the substantially parallel slits extends in a longitudinal direction of the sheet.

3. The sheet of claim 1 wherein a first concave portion of the curved corner slit and a second concave portion of the curved inner slit face one another.

4. The sheet of claim 1 wherein the positive wrap end portion of the curved corner slit is curled toward a concave portion of the curved corner slit.

5. The sheet of claim 1 wherein the positive wrap end portion of the curved corner slit engages the chime in a mounted position of the sheet with respect to the cans.

6. The sheet of claim 1 wherein the inner row comprises a plurality of inner row slits, all of the inner row slits being curved.

7. The sheet of claim 1 wherein the straight slit further comprises a curved slit portion extending from at least one end of the straight slit.

8. The sheet of claim 7 wherein a first concave portion of the curved slit portion of the straight slit and a second concave portion of the curved inner slit face one another.

9. The sheet of claim 1 having a score between the integral flap and the outermost row of the longitudinal rows.

* * * * *